US009900684B2

(12) United States Patent
Sano

(10) Patent No.: US 9,900,684 B2
(45) Date of Patent: Feb. 20, 2018

(54) MICROPHONE DEVICE

(71) Applicant: KABUSHIKI KAISHA AUDIO-TECHNICA, Machida-shi, Tokyo (JP)

(72) Inventor: Yusuke Sano, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days.

(21) Appl. No.: 15/189,552

(22) Filed: Jun. 22, 2016

(65) Prior Publication Data

US 2017/0055068 A1 Feb. 23, 2017

(30) Foreign Application Priority Data

Aug. 17, 2015 (JP) ..... 2015-160636

(51) Int. Cl.

| | |
|---|---|
| ***H04R 21/02*** | (2006.01) |
| ***H04R 1/28*** | (2006.01) |
| ***H04R 1/06*** | (2006.01) |
| *H04R 1/04* | (2006.01) |

(52) U.S. Cl.

CPC ..... *H04R 1/2876* (2013.01); *H04R 1/06* (2013.01); *H04R 1/04* (2013.01)

(58) Field of Classification Search

CPC ..... H04R 1/06; H04R 1/083; H04R 1/2869; H04R 1/2892; H04R 1/1033

USPC ..... 381/368

See application file for complete search history.

(56) References Cited

U.S. PATENT DOCUMENTS

| | | | | | |
|---|---|---|---|---|---|
| 3,944,759 | A * | 3/1976 | Penning | H04R 1/08 | 381/191 |
| 3,989,905 | A * | 11/1976 | Anderson | H04R 1/02 | 381/177 |
| 4,453,046 | A * | 6/1984 | Fidi | H04R 1/08 | 381/355 |
| 4,556,121 | A * | 12/1985 | Palmaer | A42B 3/30 | 181/129 |
| 5,363,452 | A * | 11/1994 | Anderson | H04R 19/04 | 381/170 |

(Continued)

FOREIGN PATENT DOCUMENTS

| | | |
|---|---|---|
| JP | 2008-177633 A | 7/2008 |
| JP | 2015-005942 A | 1/2015 |

*Primary Examiner* — Matthew Eason
*Assistant Examiner* — Ryan Robinson
(74) *Attorney, Agent, or Firm* — Manabu Kanesaka

(57) ABSTRACT

A microphone device includes a microphone unit that outputs an electrical signal upon receipt of a sound wave, a microphone case that supports the microphone unit in its inside with cushioning members formed of an elastic material (rubber material), and a microphone cable that supplies the electrical signal from the microphone unit to an output connector attached to the microphone case. A part of the microphone cable is attached in a state of meandering back and forth once or more between one surface and the other surface of the rear cushioning member formed in a flat manner. This configuration allows to suppress transmission of vibration through the microphone cable connected to the microphone unit and prevent generation of vibration noise due to free vibration of the microphone cable.

6 Claims, 10 Drawing Sheets

(56) References Cited

U.S. PATENT DOCUMENTS

| | | | | | |
|---|---|---|---|---|---|
| 5,410,608 | A * | 4/1995 | Lucey | H04R 1/083 | 381/360 |
| 6,128,393 | A * | 10/2000 | Kondo | H04R 9/08 | 381/355 |
| 6,226,386 | B1 * | 5/2001 | Akino | H04R 3/00 | 381/114 |
| 7,013,017 | B2 * | 3/2006 | Pavlovic | H04R 1/222 | 381/355 |
| 8,447,056 | B2 * | 5/2013 | Akino | H04R 3/04 | 381/355 |
| 8,467,558 | B2 * | 6/2013 | Okita | H04R 9/08 | 381/355 |
| 2012/0201411 | A1 * | 8/2012 | Chang | H04R 1/083 | 381/368 |
| 2014/0355808 | A1 * | 12/2014 | Akino | H04R 1/2869 | 381/356 |

* cited by examiner

MICROPHONE DEVICE

RELATED APPLICATIONS

The present application is based on, and claims priority from, Japanese Application No. JP2015-160636 filed Aug. 17, 2015, the disclosure of which is hereby incorporated by reference herein in its entirety.

BACKGROUND OF THE INVENTION

Field of the Invention

The present invention relates to a microphone device in which a microphone unit is attached inside microphone case with a cushioning member, and especially relates to a microphone device in which an arrangement of a microphone cable that leads out an electrical signal from the microphone unit is improved.

Description of the Related Art

In a case of a handheld microphone, a user directly holds the body of a microphone case. Therefore, applied vibration and acceleration are easily transmitted to the microphone unit in the microphone case. This generates a vibration noise called touch noise or handling noise.

Therefore, in this sort of microphone device, to prevent generation of the vibration noise, a configuration is employed in which the microphone unit is attached inside the microphone case with a cushioning member formed with a rubber material, and this microphone device is disclosed in patent publications, such as JP 2015-5942 A and JP 2008-177633 A.

The cushioning member that supports the microphone unit functions as a vibration isolator of the microphone unit and has a natural frequency of vibration, i.e. a resonant frequency. Therefore, when the cushioning member holding the microphone unit receives external vibration resonates, this causes to generate and output a large vibration noise output. Therefore, the resonant frequency needs to be set to a lower frequency band outside a sound collecting band of the microphone unit, or to a lower frequency band the noise at which seems to be inconspicuous even within the sound collecting band.

To achieve this, a high compliant material needs to be selected as the material of the cushioning member that functions as a vibration isolator, and accordingly the microphone unit can move in a large movable range in the microphone case.

Meanwhile, a microphone cable that leads an electrical signal from a microphone unit is connected between the microphone unit supported by the cushioning member and the microphone case that accommodates the microphone unit.

FIGS. 7 to 10 exemplarily illustrate the above-described arrangement of the microphone cable in the conventional microphone device including a cushioning member.

Note that the conventional microphone device illustrated in FIGS. 7 to 10 includes members that serve the same functions as an embodiment according to the present invention illustrated in FIGS. 1 to 6, described below, and the members are illustrated with the same reference signs. Therefore, detailed configurations of respective portions will be described below based on FIGS. 1 to 6.

A microphone cable 45 in the conventional microphone device is arranged in a space along a nearly central portion of a microphone case 30, without forming slack as possible in a substantially linear manner, and connects between a microphone unit 10 and a connector 47, as exemplarily illustrated in FIG. 7.

According to the configuration illustrated in FIG. 7, the microphone cable 45 is arranged in a state of floating in the air in a space portion between a microphone unit 10 and a connector 47. Therefore, vibration received by a microphone case 30 is transmitted to the microphone unit 10 from the connector 47 through the microphone cable 45, as schematically illustrated by the broken line. Accordingly, the vibration noise is generated.

To prevent the generation of the vibration noise through the microphone cable 45, use of a thinner wire can be suggested as the microphone cable 45.

However, when the microphone device is dropped and a large shock is applied to the microphone device, the microphone unit 10 instantly swings largely with being held by cushioning members 41 and 42. Accordingly, a problem occurs that an unreasonable tension is applied to the microphone cable 45 and the microphone cable 45 may be disconnected, as illustrated in FIG. 8.

Therefore, when sufficient looseness is provided to the microphone cable 45 connected to between the microphone unit 10 and the connector 47, as illustrated in FIG. 10, disconnection of the microphone cable 45 can be prevented if a large shock is applied to the microphone device, as described above. In this case, however, the microphone cable 45 freely vibrates, and the free vibration of the microphone cable 45 is transmitted to the microphone unit 10, as illustrated in FIG. 9, and this may cause to generate the vibration noise.

That is, the bi-directional arrow illustrated in FIG. 9 illustrates a state that the microphone cable 45 freely vibrates, and the broken line schematically illustrates a situation where the vibration of the microphone cable 45 is transmitted to the microphone unit 10.

SUMMARY OF THE INVENTION

In the microphone device in which the microphone unit is supported in the microphone case with the cushioning member, the microphone cable connecting the microphone unit and the connector has problems of generating vibration noise due to respective causes, as described based on FIGS. 7 to 10. Further, the microphone device has a problem of disconnection of the microphone cable when receiving a shock.

Therefore, an objective of the present invention is to provide a microphone device that can effectively prevent transmission of external vibration to a microphone unit through a microphone cable and transmission of vibration due to own vibration of the microphone cable to the microphone unit, and can prevent disconnection of the microphone cable even when a large shock is applied to a microphone case.

A microphone device according to the present invention includes: a microphone unit configured to output an electrical signal upon receipt of a sound wave; a microphone case that supports the microphone unit in an inside through a cushioning member formed of an elastic material; and a microphone cable configured to supply the electrical signal from a side of the microphone unit to an output connector attached to the microphone case, wherein a part of the microphone cable is attached along the cushioning member.

In this case, in one preferable embodiment, the part of the microphone cable is attached in a state of meandering back and forth once or more between one surface and the other surface of the cushioning member formed in a flat manner.

More preferably, a configuration is employed in which the microphone unit is attached to a front end portion of a unit support portion, the microphone unit is swingably supported in the microphone case together with the unit support portion in an axial direction by a front cushioning member and a rear cushioning member in at least two places front and rear of the unit support portion in the axial direction, and a part of the microphone cable is attached to the rear cushioning member close to the output connector.

Meanwhile, the rear cushioning member is formed preferably in a ring-shaped manner, has a peripheral edge portion attached to the microphone case, and swingably in the axial direction supports the unit support portion in a central portion. And a part of the microphone cable is attached in a state of meandering back and force once or more between one surface and the other surface of the cushioning member formed in a flat manner, using a plurality of through holes formed along the ring-shaped surface of the rear cushioning member.

Then, preferably, a condenser microphone unit is used as the microphone unit, a circuit board including an audio output circuit of the condenser microphone unit is mounted immediately after the condenser microphone unit in the unit support portion, and the circuit board and the output connector are connected with the microphone canle.

In addition, a configuration is employed in which the microphone cable is attached in a bundle of a plurality of signal lines, in a state of meandering back and forth once or more between one surface and the other surface of the cushioning member.

According to the microphone device of the present invention, the configuration is employed in which a part of the microphone cable that supplies an electrical signal from the microphone unit to the output connector is attached along the cushioning member formed of an elastic material.

Therefore, the part of the microphone cable is always in contact with the cushioning member formed of a rubber material, for example, and thus direct transmission of vibration received at the microphone case to the microphone unit side through the microphone cable can be prevented. Accordingly, generation of vibration noise can be effectively suppressed.

Further, since apart of the microphone cable is in contact with the cushioning member, free vibration caused in the microphone cable itself is suppressed, and generation of vibration noise due to the free vibration of the microphone cable can be suppressed.

Further, the microphone cable along the cushioning member can be arranged with some looseness. Therefore, when a shock is applied to the microphone case, the microphone cable is similarly deformed following deformation of the cushioning member. Thus, application of a force such as providing excessive tension to the microphone cable can be effectively prevented.

DESCRIPTION OF THE PREFERRED EMBODIMENTS

Figure 1:
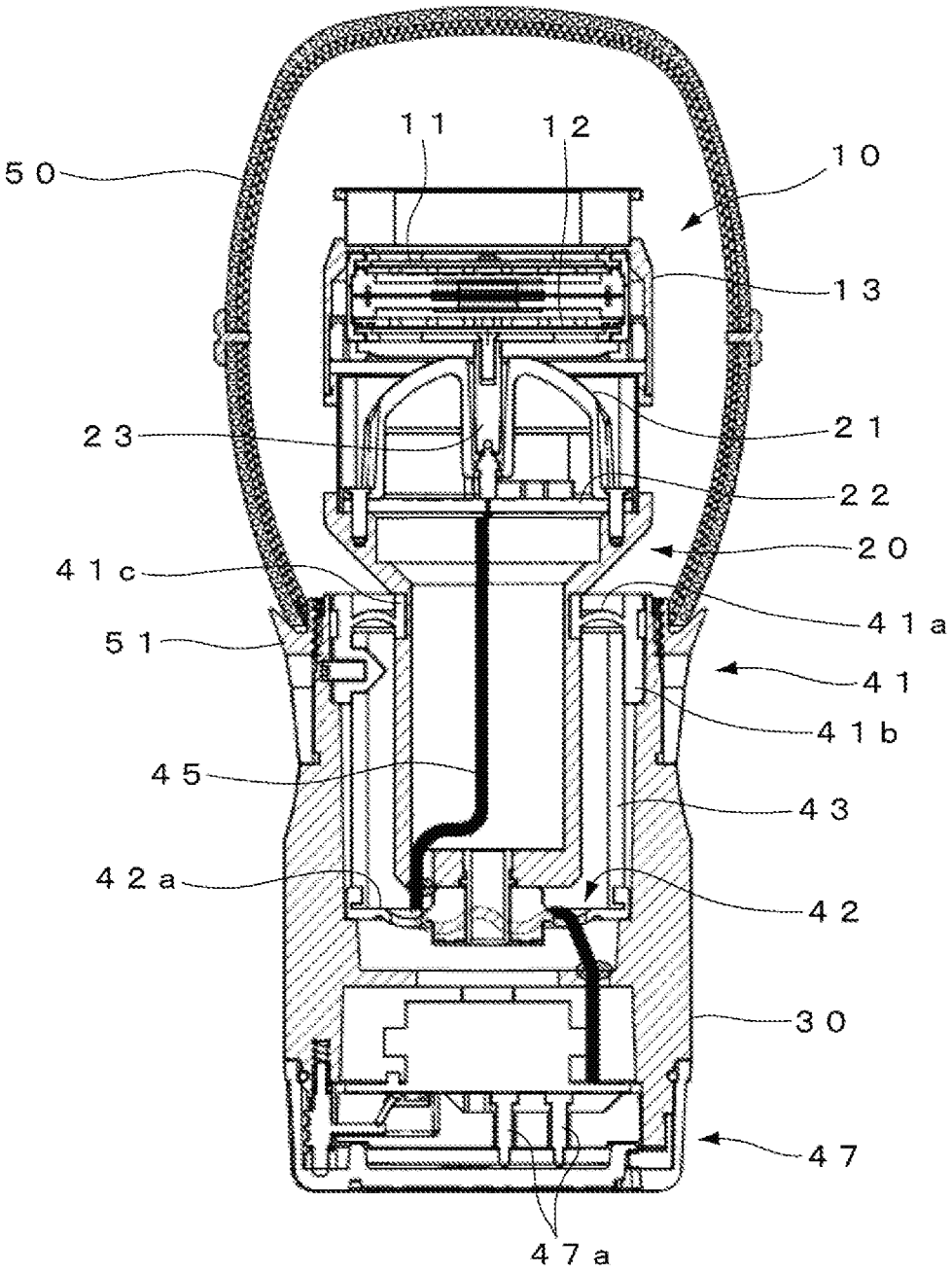
FIG. 1 is a sectional view illustrating an overall configuration of a microphone device according to the present invention.

A microphone device according to the present invention will be described based on an embodiment illustrated in the drawings.

Figure 3:
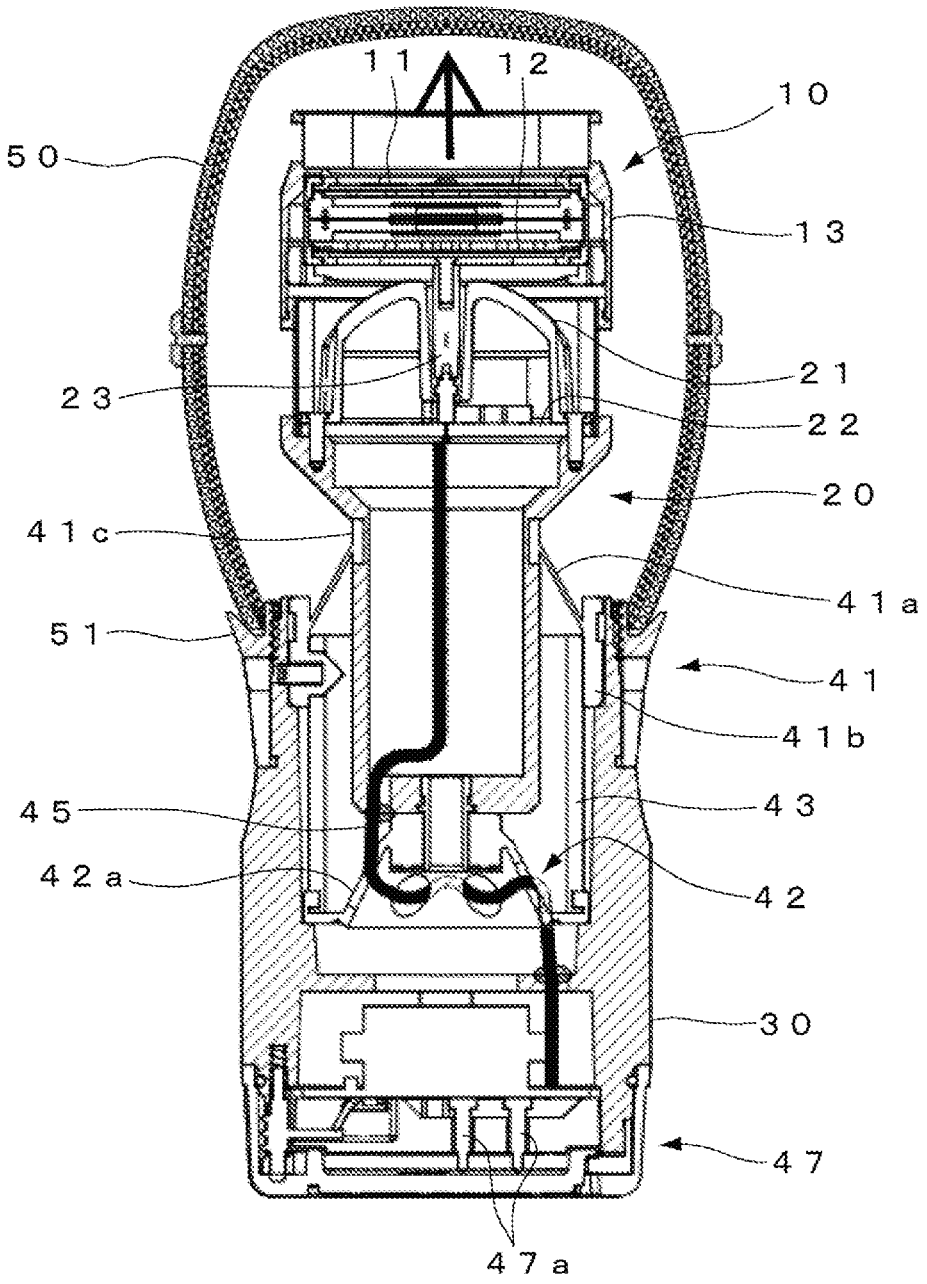
FIG. 3 is a cross-sectional view of the microphone device according to the present invention in a state where the microphone receives a mechanical shock in an axial direction.

FIGS. 1 and 3 illustrate an example in which the present invention is applied to a condenser microphone by cross-sectional views. This condenser microphone includes, as a basic configuration, a microphone unit 10, a unit support portion 20, and a microphone case 30.

In this embodiment, the microphone unit 10 is provided with a first element 11 and a second element 12 back to back.

Then, the microphone unit 10 is attached to a front end portion of the cylinder-shaped unit support portion 20 with a metal-made unit case 13.

A dome-shaped cover 21 is attached to the cylinder-shaped unit support portion 20, and a circuit board 22 including an audio output circuit of the microphone unit 10 is mounted in the unit support portion 20 right after the cover 21.

The first element 11 in the microphone unit 10 configures a back electret condenser microphone unit in which a diaphragm faces a fixed electrode.

Meanwhile, the second element 12 does not configure a condenser microphone although including a fixed electrode and a diaphragm, and substantially functions as a high-pass filter (HPF) by cutting a low frequency range off of a sound wave entering from a rear acoustic terminal, and transmitting only a high frequency range to a back surface of the first element 11. This HPF function especially improves low-range frequency characteristics of the condenser microphone.

Here, the acoustic terminal indicates a position of air that effectively provides a sound pressure to the microphone unit 10. In other words, the acoustic terminal is a central position of the air moving at the same time with the diaphragm included in the microphone unit 10. Since the microphone unit 10 is unidirectional, the acoustic terminals exist in front and back of the diaphragm, and the rear acoustic terminal is the acoustic terminal on the rear side of the diaphragm.

Then, a signal from the microphone unit 10 is led to the circuit board 22 through a relay rod 23 attached to a central portion of the dome-shaped cover 21.

Figure 2:
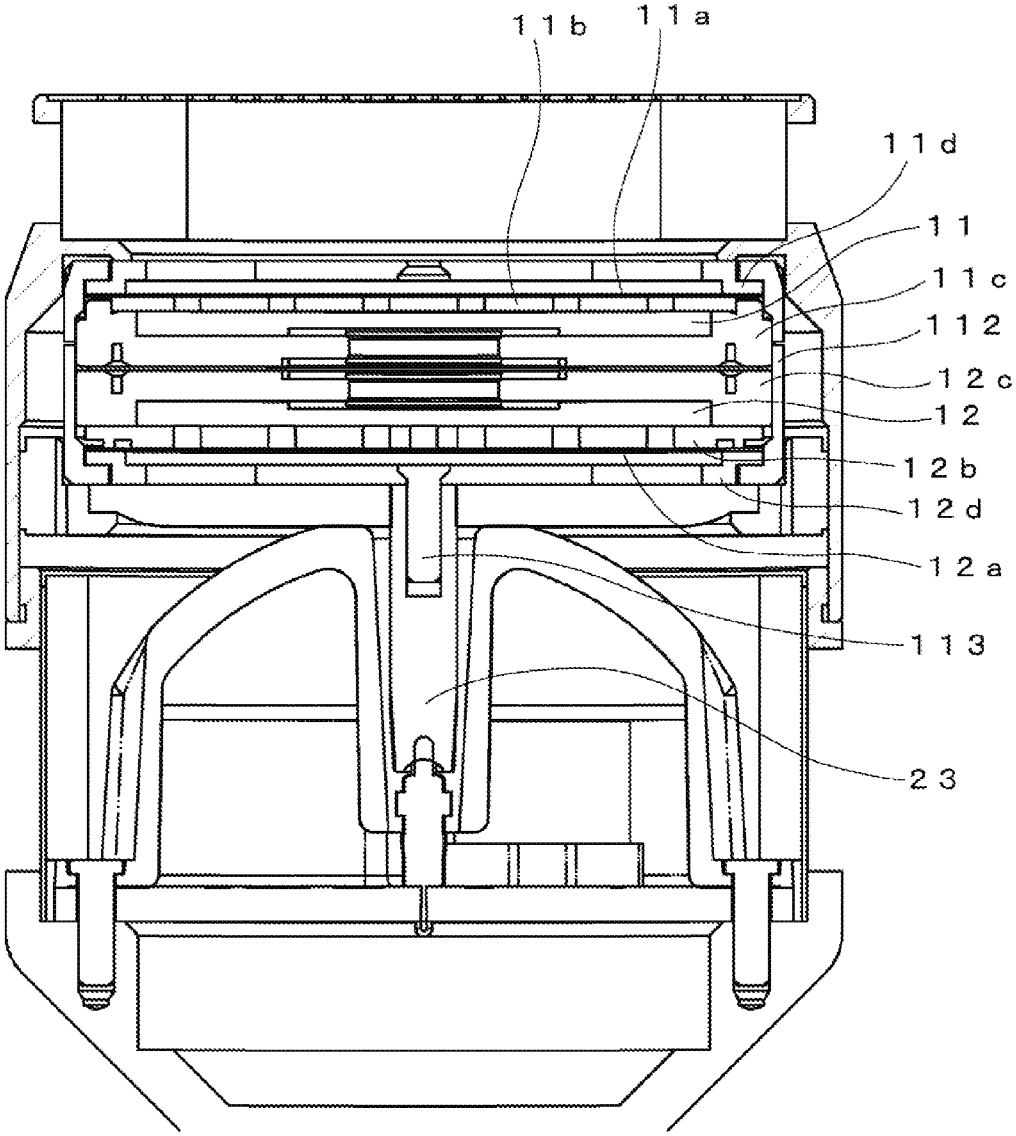
FIG. 2 is an enlarged view illustrating a microphone unit of the microphone device according to the present invention.

FIG. 2 is an enlarged view of the microphone unit 10, and hereinafter, specific description will be given. The first element 11 configures aback electret condenser microphone unit including a diaphragm 11*a* and a fixed electrode 11*b* facing the diaphragm 11*a*. Further, the fixed electrode 11*b* is supported by a support member 11*c* having electric conductivity, and the diaphragm 11*a* is supported by a diaphragm frame 11*d*.

Similarly, the second element 12 also includes a diaphragm 12*a*, a fixed electrode 12*b*, a support member 12*c*, and a diaphragm frame 12*d*.

The two support members 11*c* and 12*c* are fastened and fixed with a fastening member 112 having conductivity.

The fixed electrode 11*b* of the first element 11 is electrically connected with the support member 11*c*, the diaphragm 12*a* and the fixed electrode 12*b* of the second element 12 are electrically connected with the support member 12*c*, and the support members 11*c* and 12*c* are electrically connected with the fastening member 112 and the diaphragm frame 12*d*. Accordingly, the condenser microphone unit by the first element 11 and the high-pass filter by the second element 12 are connected in series.

Further, a conductive screw 113 is attached to the diaphragm frame 12*d*, and the relay rod 23 is electrically connected to the screw 113.

The cylinder-shaped unit support portion 20, having the microphone unit 10 mounted in the front end portion, is supported inside of the microphone case 30 in two places front and rear of the unit support portion 20 in an axial direction with a front cushioning member 41 and a rear cushioning member 42.

The front cushioning member 41 and the rear cushioning member 42 are respectively made of rubber materials, and accordingly, the microphone unit 10 is swingably supported in the microphone case 30 in the axial direction together with the unit support portion 20.

In the front cushioning member 41, an outside of a thin flat ring-shaped portion 41*a* forms a cylinder portion 41*b*, and configures an attaching portion to the microphone case 30. Further, an inside of the thin flat ring-shaped portion forms a short axial cylinder portion 41*c*, and the cylinder portion 41*c* encloses the unit support portion 20.

Then, the outside cylinder portion 41*b* of the front cushioning member 41 is sandwiched by an outer peripheral surface of a cylinder body 43 coaxially arranged in the microphone case 30 and an inner wall surface of the microphone case 30, thereby being attached in the microphone case 30.

Figure 4:
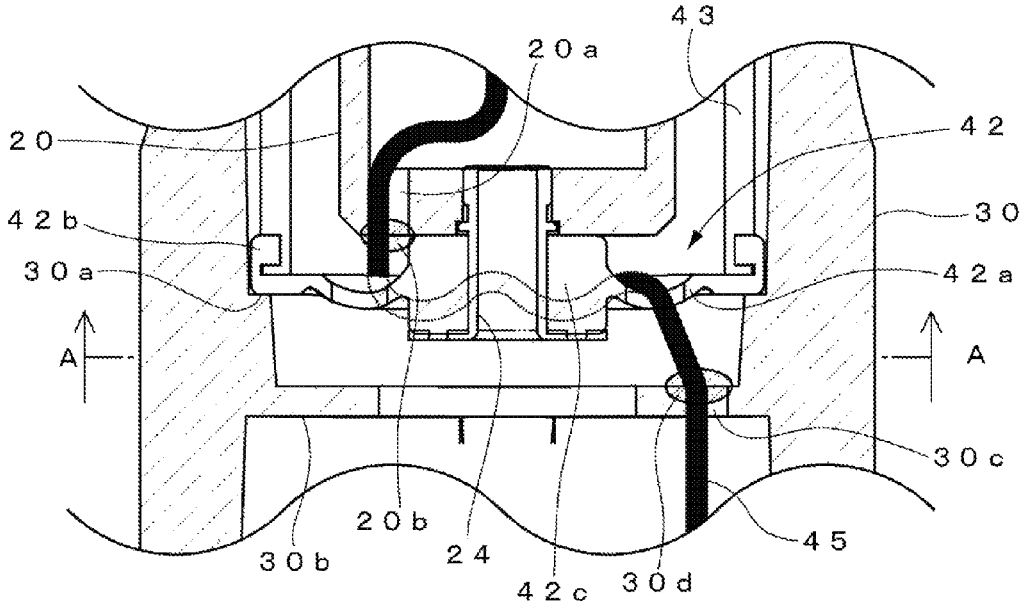
FIG. 4 is an enlarged vertical cross-sectional view illustrating an attached state of a microphone cable to a cushioning member.
Figure 5:
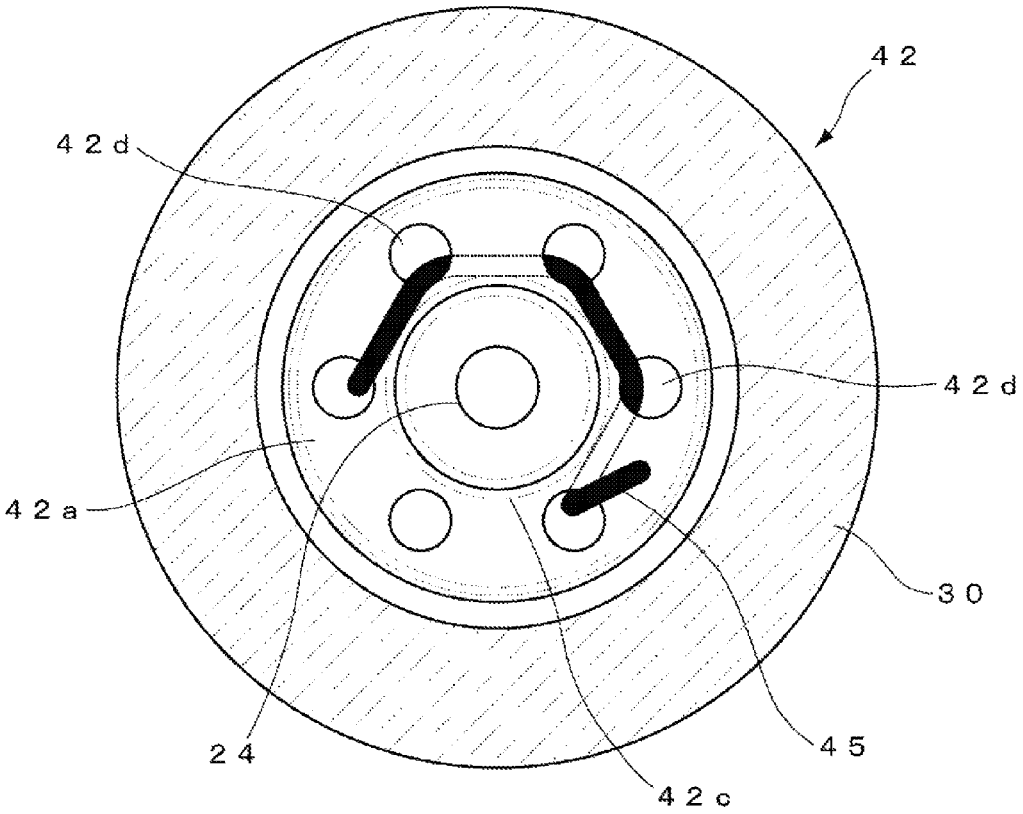
FIG. 5 is a transverse cross-sectional view taken along the A-A line as viewed in the arrow direction in FIG. 4.
Figure 6:
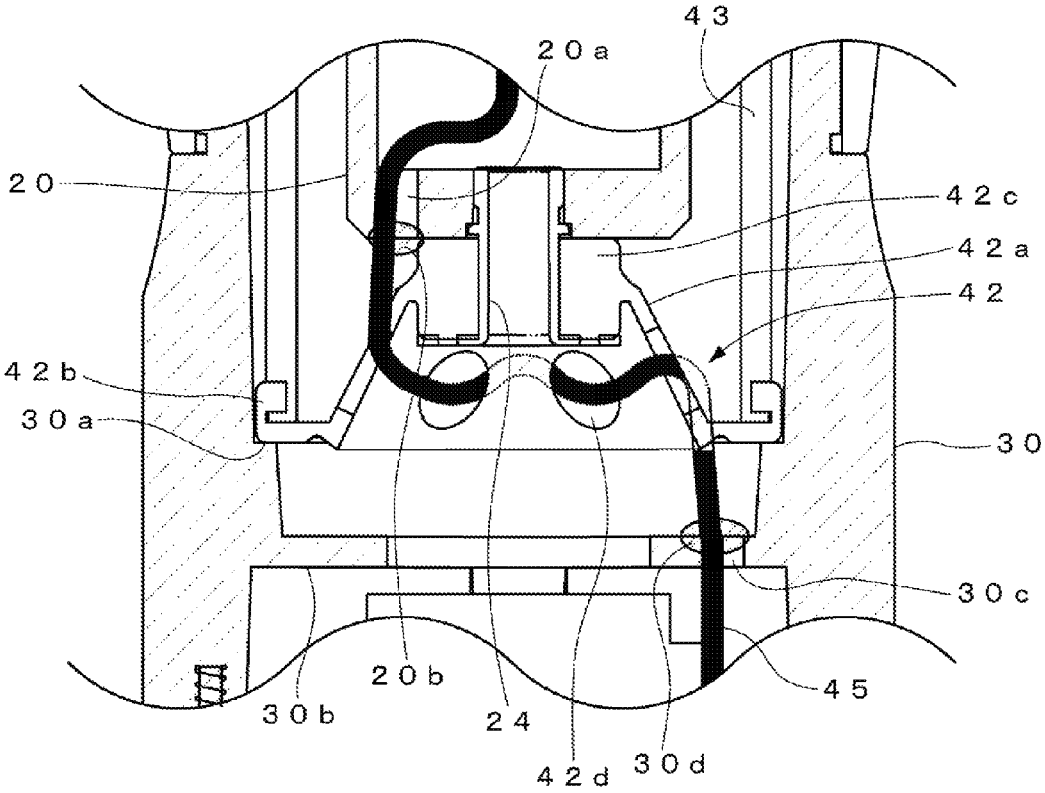
FIG. 6 is an enlarged cross-sectional view of a state where the microphone receives a mechanical shock in the axial direction as illustrated in FIG. 4.
Figure 7:
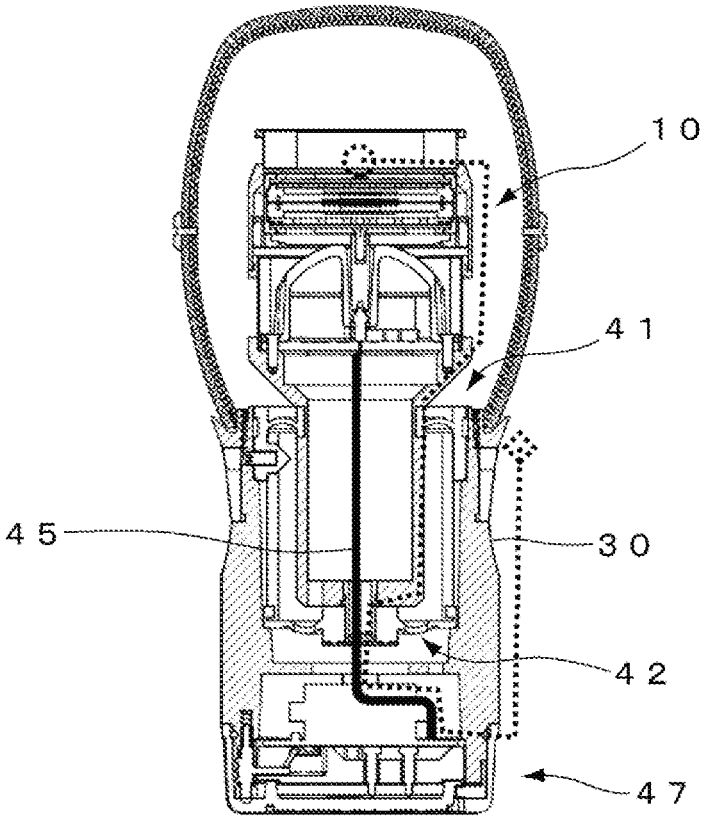
Fig. 7 Prior Art
FIG. 7 is a cross-sectional view illustrating an example of a conventional microphone device.
Figure 8:
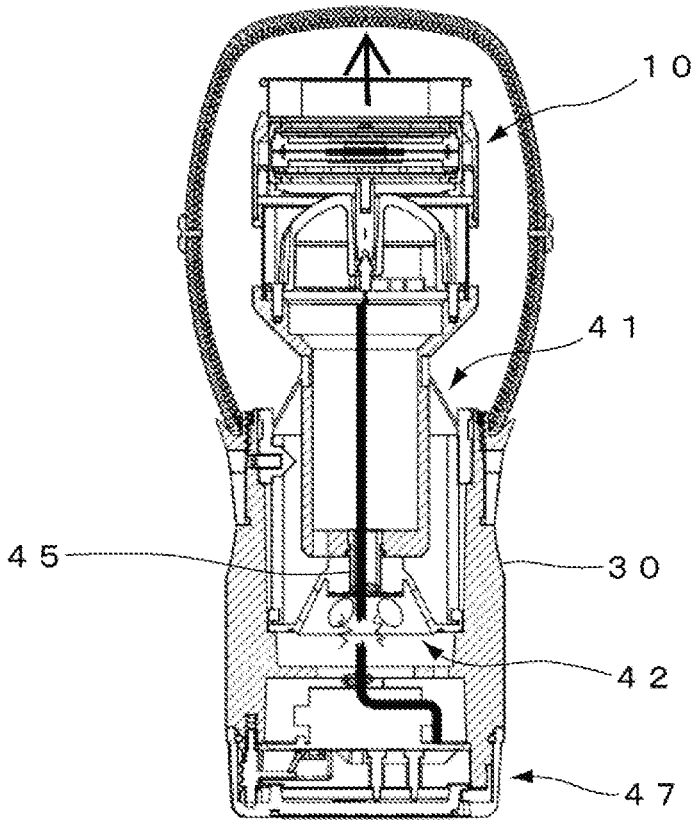
Fig. 8 Prior Art
FIG. 8 is a cross-sectional view of the conventional microphone device in a state where the microphone receives a mechanical shock in an axial direction.
Figure 9:
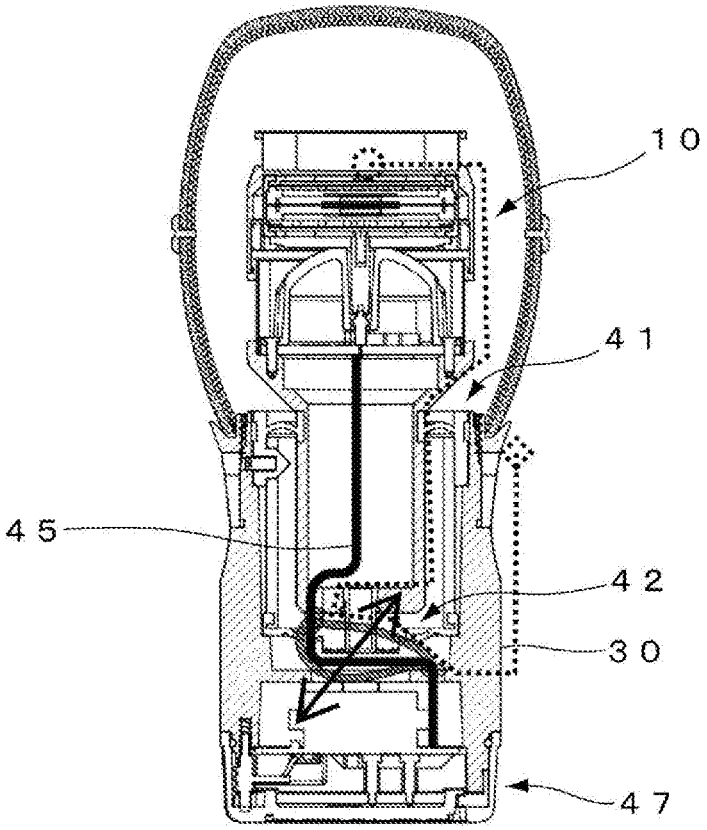
Fig. 9 Prior Art
FIG. 9 is a cross-sectional view illustrating another example of the conventional microphone device.
Figure 10:
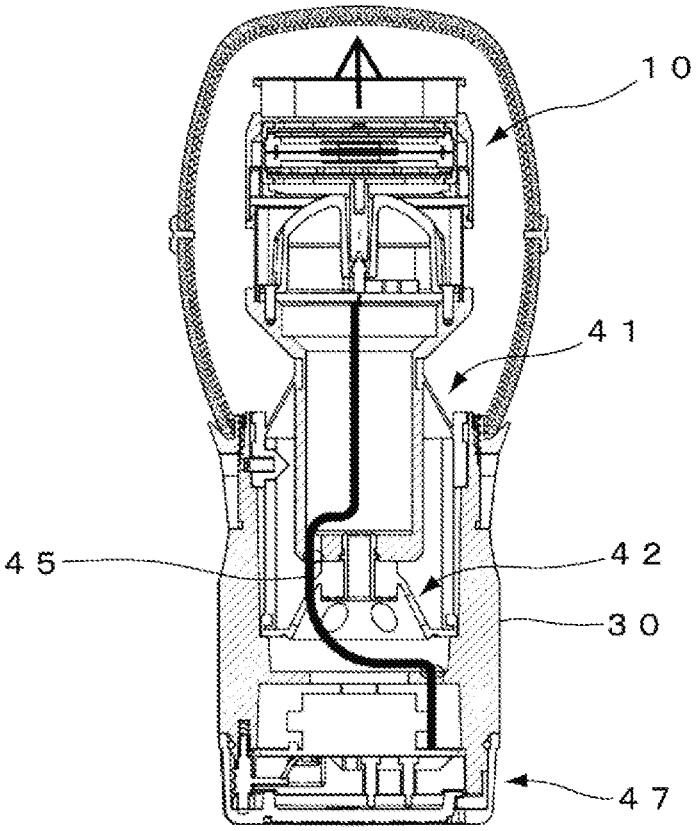
Fig. 10 Prior Art
FIG. 10 is a cross-sectional view of the conventional microphone device in a state where the microphone receives a mechanical shock in an axial direction.

Meanwhile, as illustrated in FIGS. 4 to 6, the rear cushioning member 42 includes a thin flat ring-shaped portion 42*a*. An outer peripheral edge of the thin flat ring-shaped portion 42*a* is folded back inward, and configures an attaching portion 42*b* to the microphone case 30. Further, a cylinder portion 42*c* is integrally formed with an inside of the thin flat ring-shaped portion 42*a*. This cylinder portion 42*c* surrounds a hollow axial body 24 protruding in an axial direction and attached to a lower bottom portion of the unit support portion 20. Accordingly, the rear cushioning member 42 supports the unit support portion 20 at the lower bottom portion.

Then, the attaching portion 42*b* folded back to an outer peripheral edge of the rear cushioning member 42 is locked with a lower end portion of the cylinder body 43 coaxially arranged in the microphone case 30. This locking portion is attached by coming in contact with a step portion 30*a*, having a slightly reduced inner diameter of the microphone case 30, formed inside the microphone case 30.

Note that six through holes 42*d* are formed in the thin flat ring-shaped portion 42*a* of the rear cushioning member 42 at regular intervals in a circumferential direction, as illustrated in FIG. 5. The through holes 42*d* are formed to penetrate one surface (front surface) facing the inside of the microphone case 30 and the other surface (back surface) at an opposite side to the front surface. These through holes 42*d* allow the thin flat ring-shaped portion 42*a* of the rear cushioning member 42 to be flexibly configured, and allow a part of a microphone cable 45 to meander up and down (to sew a front surface and a back surface of the through holes 42*d*) and locked.

An output connector 47 including a plurality of terminal pins 47*a* is attached to a lower end portion of the microphone case 30, and the microphone cable 45 is connected between the circuit board 22 arranged immediately after the microphone unit 10 and the output connector 47. Note that although the microphone cable 45 is illustrated as a single cable in the drawings, the single cable consists of a bundle of a plurality of signal lines.

The microphone cable 45 is then hung down in a substantially linear manner in a central portion of the unit support portion 20 from the circuit board 22, and is led out from the inside of the unit support portion 20 to the inside of the microphone case 30 through an opening 20*a* (see FIG. 4) formed in the lower bottom portion of the unit support portion 20. Further, the microphone cable 45 pulled out from the unit support portion 20 is, as illustrated in FIGS. 4 to 6, attached to the rear cushioning member 42 using the through holes 42*d* formed in the rear cushioning member 42 at regular intervals in the circumferential direction.

That is, the microphone cable 45 illustrated in the drawings is attached in a state of meandering back and forth twice and a half from the front surface side (upper surface side) to the back surface side (lower surface side) through the through holes 42*d* of the rear cushioning member 42. The microphone cable 45 pulled out to a lower surface side of the rear cushioning member 42 is then connected to the output connector 47 through an opening 30*c* formed in an inner partition wall 30*b* of the microphone case 30 in an axial direction.

The microphone cable 45 is fixed in the opening 20*a* formed in the lower bottom portion of the unit support portion 20 with an adhesive 20*b*, and is also fixed in the opening 30*c* formed in the inner partition wall 30*b* of the microphone case 30 with an adhesive 30*d*. That is, the microphone cable 45 is fixed to the unit support portion 20 and the microphone case 30 with the adhesives 20*b* and 30*d* at upper and lower portions of the rear cushioning member 42.

The microphone cable 45 fixed with the adhesives 20*b* and 30*d* then meanders along an up and down direction of the rear cushioning member 42, and is attached to the rear cushioning member 42 with some slacking.

Note that a ring member 51 to which a microphone front mesh 50 is attached is threaded into an upper end opening portion of the microphone case 30, and accordingly, the microphone unit 10 attached to the front end portion of the unit support portion 20 is covered with the microphone front mesh 50.

According to the microphone device having the above-described configuration, the microphone unit 10 is attached to the microphone case 30 together with the unit support portion 20 through the front cushioning member 41 and the rear cushioning member 42.

Therefore, even if a shock is applied to the microphone case 30, transmission of the shock to the microphone unit 10 is effectively reduced, as illustrated in FIGS. 3 to 6, and generation of vibration noise can be suppressed.

In addition, a part of the microphone cable 45 that supplies the electrical signal from the microphone unit 10 side to the output connector 47 side is attached along the rear cushioning member 42. Therefore, transmission of vibration to the microphone unit 10 side through the microphone cable 45 can be effectively prevented. Further, the rear cushioning member 42 can suppress free vibration of the microphone cable 45 itself. Therefore, suppression effects of the vibration noise can be further exhibited.

Note that the above embodiment has been described using the condenser microphone as an example. However, the present invention can be applied to dynamic microphones, for example. Especially, the dynamic microphones are susceptible to inertial force due to an increase in a weight of a voice coil, and as measurements of that, it is desirable to use a more compliant cushioning member.

According to the present invention, the microphone cable 45 can be similarly deformed following a relatively large deformation operation of the cushioning member. Therefore, the above-described functions and effects such as avoidance of application of stress to the microphone cable can be obtained.

What is claimed is:

1. A microphone device comprising:

a microphone unit configured to output an electrical signal upon receipt of a sound wave; a microphone case that supports the microphone unit in an inside with a cushioning member formed of an elastic material, wherein the cushioning member is formed in a flat manner, having a surface and an opposite surface; and a microphone cable configured to supply the electrical signal from the microphone unit to an output connector attached to the microphone case, wherein a part of the microphone cable is attached along the cushioning member, and the part of the microphone cable is attached in a state of meandering back and forth once or more between the surface and the opposite surface of the cushioning member.

2. The microphone device according to claim 1, wherein the microphone unit is attached to a front end portion of a unit support portion, the microphone unit is supported in the microphone case by a front cushioning member and a rear cushioning member in at least two places of front and rear of the unit support portion in the axial direction as swingable together with the unit support portion in an axial direction, and a part of the microphone cable is attached to the rear cushioning member close to the output connector.

3. The microphone device according to claim 2, wherein the rear cushioning member is formed in a ring-shaped manner and has a peripheral edge portion attached to the microphone case, and swingably supports the unit support portion in a central portion in the axial direction, and a part of the microphone cable is attached in a state of meandering back and forth once or more between one surface and the other surface of the cushioning member formed in a flat manner, using a plurality of through holes formed along the ring-shaped surface of the rear cushioning member.

4. The microphone device according to claim 2, wherein a condenser microphone unit is used as the microphone unit, a circuit board including an audio output circuit of the condenser microphone unit is mounted immediately after the condenser microphone unit in the unit support portion, and the microphone cable is connected between the circuit board and the output connector.

5. A microphone device comprising:

a microphone unit configured to output an electrical signal upon receipt of a sound wave;

a microphone case that supports the microphone unit in an inside with a cushioning member formed of an elastic material, the cushioning member having a surface and an opposite surface;

and a microphone cable configured to supply the electrical signal from the microphone unit to an output connector attached to the microphone case, wherein a part of the microphone cable is attached along the cushioning member, and the microphone cable is attached, in a bundle of a plurality of signal lines, in a state of meandering back and forth once or more between the surface and the opposite surface of the cushioning member.

6. The microphone device according to claim 2, wherein the microphone cable is fixed to the unit support portion and the microphone case at upper and lower portions of the rear cushioning member, the microphone cable meanders along an up and down direction of the rear cushioning member and is attached to the rear cushioning member with some slacking.

* * * * *